United States Patent [19]

Hayashi

[11] Patent Number: 4,459,540

[45] Date of Patent: Jul. 10, 1984

[54] CONSTANT VOLTAGE GENERATING CIRCUIT

[75] Inventor: Shigekazu Hayashi, Hyogo, Japan

[73] Assignee: Mitsubishi Denki Kabushiki Kaisha, Tokyo, Japan

[21] Appl. No.: 351,382

[22] Filed: Feb. 23, 1982

[30] Foreign Application Priority Data

Feb. 25, 1981 [JP] Japan ..... 56-27231

[51] Int. Cl.[3] ..... G05F 3/08

[52] U.S. Cl. ..... 323/314; 323/907

[58] Field of Search ..... 323/313, 314, 315, 316, 323/907; 307/296 R, 297, 310

[56] References Cited

U.S. PATENT DOCUMENTS 3,619,659 11/1971 Meyer et al. ..... 307/310 X
3,851,190 11/1974 Hongu et al. ..... 307/310
4,119,869 10/1978 Hashimoto et al. ..... 323/315 X

*Primary Examiner*—Peter S. Wong
*Attorney, Agent, or Firm*—Sughrue, Mion, Zinn, Macpeak and Seas

[57] ABSTRACT

A constant voltage generating circuit is designed so that the output thereof is temperature compensated. In particular, the device is provided with a first circuit containing p-n junctions (diodes, transistors etc.), the number of which is selected to compensate for any temperature dependance of a second, voltage level down or up circuit.

8 Claims, 5 Drawing Figures

CONSTANT VOLTAGE GENERATING CIRCUIT

BACKGROUND OF THE INVENTION

This invention relates to a temperature-compensated constant voltage generating circuit.

A conventional circuit of this type is as shown in FIG. 1. In FIG. 1, reference numeral 1 designates a resistor; 2, a series circuit of m diodes; 3, a resistor; and 4, a voltage supply terminal. These elements 1, 2, 3 and 4 provide a voltage level $V_1$. Further in FIG. 1, reference numeral 5 designates a level down circuit for shifting down the voltage level $V_1$ by a voltage which is represented by the sum of n (n being an integer) times the base-emitter voltage of a transistor or the anode-cathode voltage of a diode, i.e., a p-n junction voltage, and a predetermined voltage; reference numeral 6 designates the input terminal of the circuit 5; reference numeral 7 designates the output terminal of the circuit 5; and reference character $V_2$ designates the voltage level at the output terminal 7. One example of the aforementioned level down circuit is as shown in FIG. 2. In FIG. 2, reference numerals 4, 6 and 7 designate elements denoted by the same reference numerals in FIG. 1; 21, 22 and 23 are NPN transistors; 24 is a diode; 25 is a resistor; and 26, 27 and 28 are current sources. With n=4, the voltage drop across the resistor 25 corresponds to the above-described predetermined voltage.

The operation of the circuit will now be described.

The voltage levels $V_1$ and $V_2$ are represented by the following expressions (1) and (2) respectively:

$$V_1 = V_{cc} - \frac{(V_{cc} - m \cdot V_{BE}) \cdot R_1}{R_1 + R_2} = \frac{V_{cc} + m \cdot (R_1/R_2) \cdot V_{BE}}{1 + (R_1/R_2)} \quad (1)$$

$$V_2 = V_1 - (n \cdot V_{BE} + V_O) \quad (2)$$

where $V_{BE}$ is the base-emitter voltage of the transistor or the anode-cathode voltage of the diode, $R_1$ is the resistance of the resistor 1, $R_2$ is the resistance of the resistor 3, $V_{cc}$ is the supply voltage, and $V_O$ is the voltage drop across the resistor 25.

If A is inserted for $R_1/R_2$ is expression (2), then expression (2) can be rewritten as follows:

$$V_2 = \frac{\{m \cdot A - n \cdot (1 + A)\}}{1 + A} \cdot V_{BE} + \left(\frac{V_{cc}}{1 + A} - V_O\right) \quad (3)$$

If the values $V_{cc}$, $V_O$ and $R_1/R_2$ are constant irrespective of temperature variation, then the second term in expression (3) is constant irrespective of any temperature variation. Therefore, in order to maintain $V_2$ unchanged despite a temperature variation, the first term should be equal to zero. Therefore, the condition for making the value of $V_2$ independent of temperature is:

$$m \cdot A - n \cdot (1 + A) = 0 \quad (4)$$

If B is used in place of $R_2/R_1$, expression (4) can be rewritten as follows:

$$m = n \cdot (1 + B) \quad (5)$$

When expression (5) holds true, $V_2$ is:

$$V_2 = \frac{V_{cc}}{1 + (1/B)} - V_O \quad (6)$$

Where the circuit shown in FIG. 1 is used practically, $V_2$, $V_O$, $V_{cc}$ and n are given so that B ($=R_2/R_1$) and m are determined from expressions (5) and (6). In this case, the following two problems are involved:

1. The value m must be an integer. Therefore, as is apparent from expression (5), the variation of $V_2$ due to temperature variation can be made zero only when $n \cdot R_2/R_1$ is an integer.

2. If, even when $n \cdot R_2/R_1$ is an integer, n or $R_2/R_1$ is large, then m becomes considerably large. In practice, it is impossible to realize such a circuit.

In conclusion, it is, in general, impossible to make the variation of $V_2$ due to temperature variation equal to zero with the circuit shown in FIG. 1.

SUMMARY OF THE INVENTION

As is apparent from the above description, the conventional circuit is deficient in that, in general, it is impossible to completely compensate for the variation of the output voltage level due to temperature variation.

Accordingly, an object of this invention is to provide a circuit which can in all cases completely compensate for the variation of an output voltage level due to temperature variations.

DETAILED DESCRIPTION OF THE PREFERRED EMBODIMENTS

Figure 3:
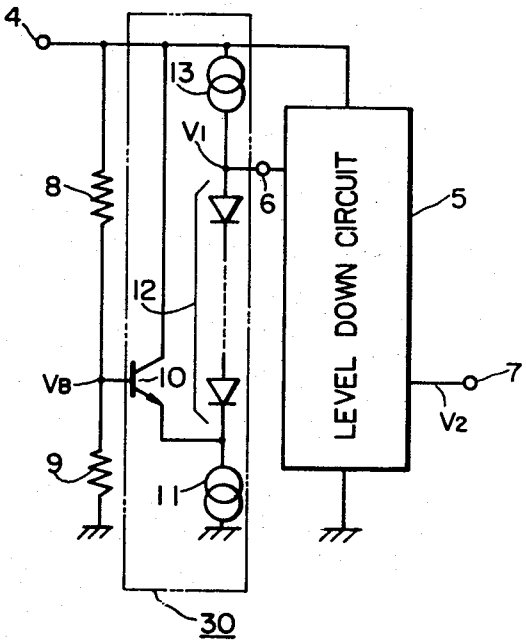
FIG. 3 is a circuit diagram illustrating a first embodiment of the invention.
Figure 2:
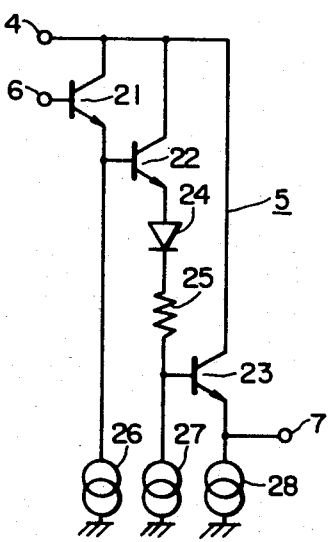
FIG. 2 PRIOR ART
FIG. 2 is a circuit diagram showing one example of a level down circuit used in FIG. 1.

One embodiment of the invention is as shown in FIG. 3. In FIG. 3, reference numerals 4, 5, 6 and 7 designate elements denoted by like reference numerals in FIG. 1; 8 and 9 are resistors for dividing a supply voltage to obtain a reference voltage level $V_B$; 10 is an NPN transistor, 11 is a current source; 12 is a series circuit of m' diodes; and 13 is a current source. The circuit elements 10, 11, 12 and 13 form a first circuit 30 for shifting up the reference voltage level $V_B$ to a first voltage level $V_1$. The level down circuit 5 represents a second circuit which receives the first voltage level $V_1$ and shifts down the latter by a voltage which is the sum of an integer times a p-n junction voltage and a predetermined voltage, to provide an output voltage level.

Figure 1:
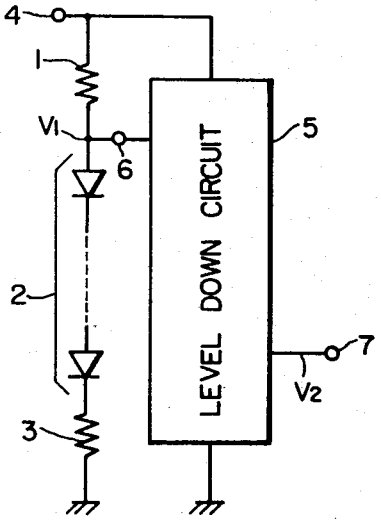
FIG. 1 PRIOR ART
FIG. 1 is a circuit diagram illustrating a conventional temperature-compensated constant voltage generating circuit.

The operation of the circuitry in FIG. 3 will be described by using the same reference symbols as those in the description of FIG. 1.

$$V_1 = \frac{V_{cc}}{1 + (R_{1'}/R_{2'})} + (m' - 1) \cdot V_{BE} \quad (7)$$

$$V_2 = V_1 - (n \cdot V_{BE} + V_O) \quad (8)$$

where $R_{1'}$ is the resistance of the resistor 8, and $R_{2'}$ is the resistance of the resistor 9.

From expressions (7) and (8), $$V_2 = (m' - n - 1) \cdot V_{BE} + \left( \frac{V_{cc}}{1 + (R_{1'}/R_{2'})} - V_O \right) \quad (9)$$

If $V_{cc}$, $V_O$ and $R_{1'}/R_{2'}$ are constant irrespective of temperature variation, then the second term in expression (9) is constant irrespective of any temperature variation. Thus, the condition for making the value $V_2$ independent of temperature change is:

$$m' - n - 1 = 0 \quad (10)$$

or $$m' = n + 1 \quad (11)$$

When expression (11) holds true, then $$V_2 = \frac{V_{cc}}{1 + (R_{1'}/R_{2'})} - V_O \quad (12)$$

Therefore, when $V_2$, $V_O$, $V_{cc}$ and n are given, it is always possible to determine $R_{1'}/R_{2'}$ and m' from expressions (11) and (12). Thus, it is possible to realize a circuit which can render the variation of $V_2$ due to temperature variation equal to zero in all cases.

Figure 5:
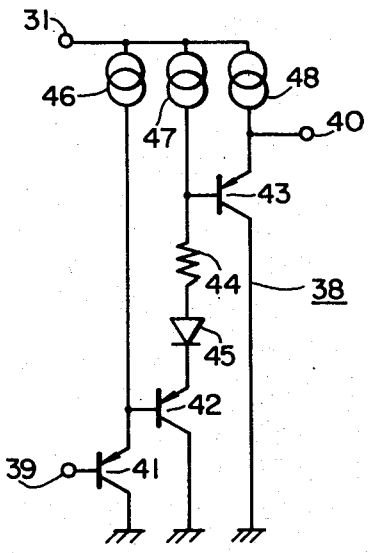
FIG. 5 is a circuit diagram showing one example of a level up circuit used in FIG. 4.
Figure 4:
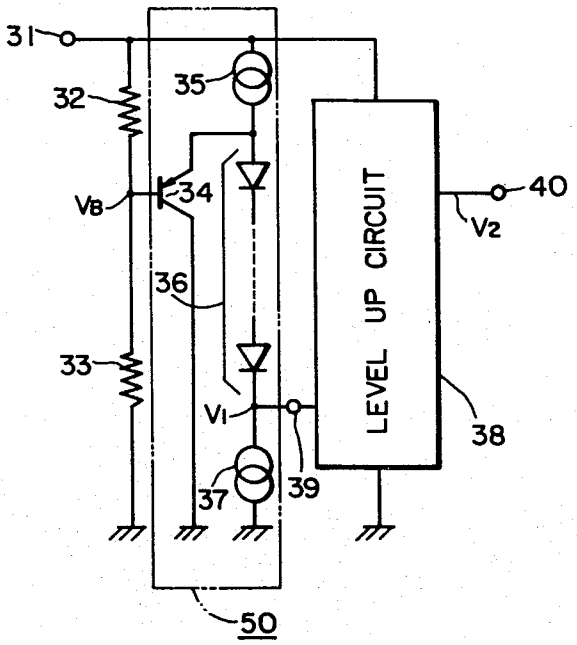
FIG. 4 is a circuit diagram depicting a second embodiment of the invention.

A second embodiment of the invention is as shown in FIG. 4. As is apparent from a comparison of FIG. 4 with FIG. 3, in the second embodiment, instead of the level down circuit 5 (FIG. 3) a level up circuit is employed. In FIG. 4, reference numeral 31 designates a voltage supply terminal; 32 and 33 are resistors for dividing a supply voltage to obtain a reference voltage level $V_B$; 34 is a PNP transistor; 35 is a current source; 36 is a series circuit of m' diodes; and 37 is a current source. The circuit elements 34, 35, 36 and 37 form a first circuit 50 for shifting down the reference voltage level $V_B$ to a first voltage level $V_1$. Further in FIG. 4, reference numeral 38 designates a second circuit which shifts up the first voltage level $V_1$ by a voltage which is the sum of n (n being an integer) times the base-emitter voltage of a transistor or the anode-cathode voltage of a diode, i.e., a p-n junction voltage, and a predetermined voltage; reference numeral 39 designates the input terminal of the second circuit 38; reference numeral 40 designates the output terminal of the second circuit 38; and reference character $V_2$ designates the second voltage level at the output terminal 40. One example of the level up circuit 38 is as shown in FIG. 5. In FIG. 5, reference numeral 31, 39 and 40 designate elements designated by the same reference numerals in FIG. 4; 41, 42 and 43 are PNP transistors; 44 is a resistor; 45 is a diode; and 46, 47 and 48 are current sources. With n=4, a voltage drop across the resistor 44 corresponds to the aforementioned predetermined voltage. The principle of operation of the second embodiment is similar to that of the first embodiment of FIG. 3.

Thus, a constant voltage generating circuit in which the variation of the output voltage level due to temperature variations may be completely compensated in all cases can be realized according to the invention. The invention has been described on the assumption that $V_{cc}$, $V_O$ and $R_{1'}/R_{2'}$ are not affected by temperature variation. $V_{cc}$ is originally constant, and therefore there is no problem in maintaining this parameter constant. In addition, in the case of an integrated circuit, $R_{1'}/R_{2'}$ can readily be maintained unchanged irrespective of a temperature variation. Even in the case where the voltage drop $V_O$ is affected by a temperature variation, the employment of the invention is more effective in minimizing the variation of the output level $V_2$ due to temperature variation than the prior art.

What is claimed is:

1. A constant voltage generating circuit, comprising:

a first circuit for shifting a reference voltage level to a first voltage level through p-n junction means;

a second circuit for shifting said first voltage level by a voltage which is equal to the sum of an integer times a p-n junction voltage, and a predetermined voltage, to provide an output; and the number of p-n junctions in said first circuit being selected to compensate for a temperature characteristic of said second circuit.

2. A constant voltage generating circuit as claimed in claim 1, said first circuit comprising a pair of current sources, said p-n junctions arranged serially between said current sources, and a transistor supplied with said reference voltage.

3. A constant voltage generating circuit as claimed in claim 2, said reference voltage being applied to the base of said transistor, which has an emitter connected between one of said current sources and said p-n junctions.

4. A constant voltage generating circuit as claimed in claim 1, said second circuit comprising a level decreasing circuit, said first voltage level being shifted downwardly.

5. A constant voltage generating circuit as claimed in claim 1, said second circuit comprising a level increasing circuit for shifting said first voltage level upwardly.

6. A constant voltage generating circuit as claimed in claim 5, said first circuit reducing said reference voltage level to obtain said first voltage level.

7. A constant voltage generating circuit as claimed in claim 6, said first circuit comprising first and second current sources, a plurality of serially connected p-n junctions between said first and second sources, and a transistor receiving said reference voltage at a base thereof and having an emitter connected between said first current source and said p-n junctions.

8. A constant voltage generating circuit as claimed in claims 5 or 6, wherein said second circuit comprises a triad of current sources, a plurality of PNP transistors, wherein at least one of said plurality of PNP transistors is coupled in series with a respective one of said current sources, and a resistor connected between one of said current sources and one of said transistors, a voltage drop across said resistor comprising said predetermined voltage.

* * * * *